US010695655B1

(12) United States Patent
Chung

(10) Patent No.: US 10,695,655 B1
(45) Date of Patent: Jun. 30, 2020

(54) REVOLUTE FLOATING KINGPIN TRUCK FOR A RIDING DEVICE

(71) Applicant: Rasyad Chung, Berkeley, CA (US)

(72) Inventor: Rasyad Chung, Berkeley, CA (US)

( * ) Notice: Subject to any disclaimer, the term of this patent is extended or adjusted under 35 U.S.C. 154(b) by 0 days.

(21) Appl. No.: 16/405,730

(22) Filed: May 7, 2019

Related U.S. Application Data

(60) Provisional application No. 62/668,356, filed on May 8, 2018.

(51) Int. Cl.
*A63C 17/01* (2006.01)
*A63C 17/00* (2006.01)

(52) U.S. Cl.
CPC ..... *A63C 17/012* (2013.01); *A63C 17/0093* (2013.01)

(58) Field of Classification Search
CPC ..... A63C 17/012; A63C 17/011
See application file for complete search history.

(56) References Cited

U.S. PATENT DOCUMENTS 6,182,987 B1 2/2001 Bryant
6,224,076 B1 5/2001 Kent
6,474,666 B1 11/2002 Andersen et al.
6,520,517 B1 2/2003 Chung et al.
6,793,224 B2 9/2004 Stratton
7,044,485 B2 * 5/2006 Kent ..... A63C 17/0093 280/11.28
7,104,558 B1 9/2006 Saldana
8,579,300 B2 11/2013 Fraley
8,800,935 B2 8/2014 Francis
9,145,030 B2 * 9/2015 Williams ..... B60B 35/025
9,821,215 B2 * 11/2017 Ivazes ..... A63C 17/0046
9,901,807 B2 * 2/2018 Su ..... A63C 17/012
10,160,507 B2 * 12/2018 Chung ..... B62K 3/002
2004/0145142 A1 * 7/2004 Wang ..... A63C 17/01 280/87.042
2005/0167938 A1 * 8/2005 Chung ..... A63C 17/01 280/87.042
2011/0316245 A1 * 12/2011 Burke ..... A63C 17/0093 280/11.27
2014/0027989 A1 * 1/2014 Baumann ..... A63C 17/012 280/11.27

* cited by examiner

*Primary Examiner* — John D Walters
*Assistant Examiner* — James J Triggs
(74) *Attorney, Agent, or Firm* — Adams Law Office; Sharon Adams

(57) ABSTRACT

A truck for a riding device with three primary motions of leaning, steering, and floating, comprising three rigid bodies, a baseplate, a revolute floating kingpin, and a hanger. A revolute joint moveably connects the kingpin and baseplate, an upper spherical joint moveably connects the baseplate and hanger, and a lower spherical joint moveably connects the hanger and kingpin. The upper and lower spherical joints define a hanger pivot axis, with a virtual pivot point at the intersection of the hanger pivot axis and a line vertically projected from the axle axis. A longitudinal roll axis is coincident with the axis of rotation of the revolute joint. In a riding device, a virtual pivot point roll axis is coincident with a virtual line between a virtual pivot point of the front truck and a virtual pivot point of the rear truck.

12 Claims, 11 Drawing Sheets

REVOLUTE FLOATING KINGPIN TRUCK FOR A RIDING DEVICE

CROSS-REFERENCE TO RELATED APPLICATION

This application claims the benefit of U.S. provisional application No. 62/668,356, filed May 8, 2018, entitled Skateboard with Revolute Floating Kingpin Trucks, and naming Rasyad Chung as the inventor, which is hereby incorporated by reference in its entirety.

STATEMENT REGARDING PRIOR DISCLOSURES BY THE INVENTOR OR A JOINT INVENTOR

The following disclosure is submitted: U.S. Pat. No. 10,265,606 issued on Apr. 23, 2019.

BACKGROUND OF THE INVENTION

Since the early 1960s there has been a strong connection between surfing and skateboarding that has influenced the history of skateboard design as well as the larger culture of board sports. Terms like "sidewalk surfing" and "surfing-like ride and feel" speak to this connection and have been used to describe ways skateboards attempt to mimic the sensations and ride dynamics of surfing.

Surfing, and other board sports share common ride dynamics of deep deck lean, stability at speed and the ability to "carve" turns.

"Carving" is the ability to make turns and control speed and is associated with deep deck lean and a feeling of "sinking into" the turn such that the deeper the deck or board is leaned the stronger the carving sensations. Carving turns typically involves higher speed and higher turn forces that must be matched by rider input, commitment, and advanced skill. With carving there is also a weightless, floating sensation experienced in the transition between linked turns.

The lean-steering mechanism of skateboards, skates and the like is commonly referred to as the "truck-assembly", or simply a "truck". A skateboard truck typically comprises two rigid bodies generally referred to as a baseplate and a hanger where the baseplate is mounted to a deck and the hanger supports two laterally spaced wheels that roll on the ground. The rigid bodies of baseplate and hanger are kinematically linked so as to allow rotation relative to each other about a common axis defined by the geometry of the baseplate called here the "hanger pivot axis".

A skateboard typically comprises a deck upon which the rider stands and a pair of trucks symmetrically mounted to each end of the deck. So constrained by the plane of the ground, a rider standing on the deck leans the deck right to steer right and left to steer left.

Existing skateboard trucks known as fixed kingpin trucks consist of mechanisms with two rigid bodies. The present invention introduces a new class of skateboard truck with three rigid bodies, an additional degree of freedom that is not present in existing skateboard trucks, and three primary motions which provide deep deck lean, improved steering control, improved stability at speed, and improved suspension. By delivering this combination of functional attributes the present invention is thus of great use to skateboard riders in search of a more powerful surfing-like ride feel.

Fixed Kingpin Trucks—Kinematic Description (Description of Space Mechanism)

As shown in FIGS. 2-5, fixed kingpin trucks of prior art are a class of trucks that utilize two rigid bodies: (1) a baseplate/fixed kingpin 901 and (2) a hanger 902.

Kinematic diagram FIG. 4 shows the pair of rigid bodies: baseplate/fixed kingpin assembly 901 and hanger 902 connected by semi-spherical joints 911 and 912.

A "hanger pivot plane" 910 is a central longitudinal plane of baseplate/fixed kingpin assembly 901 perpendicular to top mounting surface 904 of baseplate 905 as shown in FIG. 5 and coincident with the axis 925 of fixed kingpin 915. With fixed kingpin trucks the hanger pivot plane remains perpendicular to the baseplate and coincident with the centroid point of the first and second semi-spherical joints 911 and 912.

Hanger pivot axis 914 is defined by the centroid points of the first and second semi-spherical joints 911 and 912 and coincidence with hanger pivot plane 910. With fixed kingpin trucks hanger pivot axis 914 provides a single degree of freedom about which the pair of rigid bodies baseplate/fixed kingpin assembly 901 and hanger 902 rotate relative to each other.

A "hanger pivot axis angle" 919 is defined by the inclined angle of the hanger pivot axis 914 relative to the top surface 904 of baseplate 905 that supports the skateboard deck.

A "virtual pivot point" 916 is located at the intersection of the hanger pivot axis 914 and line 926 vertically projected from the center of hanger axle axis 913. The assembly of a skateboard with two fixed kingpin trucks creates a single deck roll axis called here the "virtual pivot point roll axis" 917 that is defined by the virtual pivot points 916 of the front and rear trucks.

As described fixed kingpin trucks can be understood as a space mechanism with two rigid bodies and a single degree of freedom.

Fixed Kingpin Trucks—General Description

FIG. 5 shows the typical features and assembly of a fixed kingpin truck. Baseplate 905 has a recess 918 with a plastic pivot cup insert that receives the end of the pivot arm 920 of hanger 902 to form a first semi-spherical joint 911. Baseplate 905 contains kingpin 915 that extends downward at an inclined angle. The kingpin 915 is typically fixed to baseplate 905 by press fit, threaded, or bolted connections, and therefore functions as a single rigid body called here baseplate/fixed kingpin assembly 901.

Hanger 902 has a pivot arm 920 and a centrally positioned, ring-shaped yoke 921 that receives the fixed kingpin 915. When assembled the ring-shaped yoke of the hanger is sandwiched between elastomeric bushings 922 and 923 to form a second elastomerically constrained spherical joint 912. The elastomeric bushings are integral to truck assembly and provide a return-to-center force.

Hanger axle members 903 support a pair of laterally spaced wheels. That assembly is typically completed by tightening the kingpin nut 924 to preload the elastomeric bushings 922 and 923 and constrain the yoke surfaces of the hanger with the fixed kingpin 915. Tightening the kingpin nut also constrains the first semi-spherical joint 911 of the baseplate pivot cup 918 and hanger pivot arm 920 from coming apart.

Fixed Kingpin Trucks—Kinetic Description (Description of Forces that Cause Motion).

In use a rider stands on the deck of an assembled skateboard and the wheels are constrained by the plane of the ground. On a skateboard with fixed kingpin trucks rider input to lean the deck directly causes the rotation of the deck and baseplates and hanger pivot plane 910 to rotate about the virtual pivot point roll axis 917 and the hangers to rotate about the hanger pivot axis of each truck resulting in the classic lean-steering response of the wheels on the ground. Springs or elastomeric components provide a return to center force.

Fixed Kingpin Trucks—Ride Dynamics.

Fixed kingpin trucks typically have a limited range of adjustment which is not ideal because the firmness of the elastomeric bushing and preload adjustment must match both rider weight and specific style of riding. As well, fixed kingpin trucks with bushings that are too soft for rider weight, are worn, or are too loosely adjusted become unstable at higher speeds. Consequently, riders must carefully choose between bushing durometer and preload adjustments that favor deeper deck lean and turning at slower speed or limited deck lean and greater stability at higher speed.

Design and geometry of fixed kingpin trucks have become specialized and optimized for specific speed ranges requiring riders to choose between (1) fixed kingpin trucks optimized for deeper deck lean or (2) fixed kingpin trucks optimized for stability at higher speed that consequently have a limited range of deck lean and do not turn well at slower speed.

With this specialization, skateboards with fixed kingpin trucks are not able to deliver the combined functionality of deep deck lean, turning, and stability across all speed ranges.

BRIEF SUMMARY OF THE INVENTION

The present invention comprises a truck assembly and also a skateboard assembly comprised of two trucks and a deck. The truck assembly may be used with a skateboard, or with any riding device with a deck, as a non-limiting example scooters. The skateboard and truck of the present invention provides the combined functionality of deep deck lean, improved steering control over a wider range of speed, improved speed stability, and improved suspension compared to existing skateboard trucks.

Compared to fixed kingpin trucks that have two rigid bodies and one degree of freedom the present invention has three rigid bodies and two degrees of freedom.

Conventional skateboards with fixed kingpin trucks have a lean-steering response such that in use rider input leaning the deck directly causes steering. In contrast, skateboards with trucks of the present invention uses elastomeric bushings to couple the motions of leaning and steering. In use, rider input to lean the deck compresses elastomeric bushings which then transfer torque between the three rigid bodies and by so doing couple the motions of leaning and steering that would otherwise be independent.

When existing trucks are connected with a skateboard and a user is riding the skateboard, the truck/skateboard assembly has two primary motions that are linked and called lean-steering. When the trucks of the present invention are connected with a skateboard, and a rider is using the skateboard, the truck/skateboard assembly has three primary motions, leaning, steering, and float.

With a skateboard of the present invention a new motion of floating is introduced and is understood to be an adjustable range of independence between the motions of leaning and steering.

BRIEF DESCRIPTION OF THE DRAWINGS OF THE PRESENT INVENTION

Figure 29:
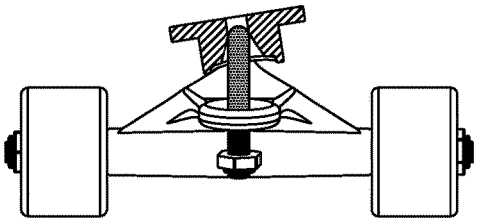
Figure 30:
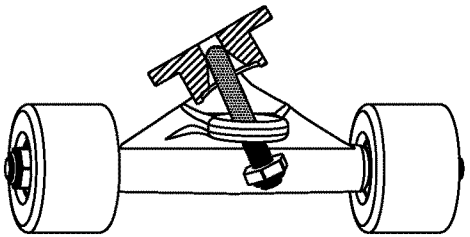

FIG. 29 shows a rear partial section view of the first embodiment of the present invention with initial left leaning baseplate 100, with partial left side compression of upper elastomeric component 140 (not shown), and hanger 160 not steering FIG. 30 shows a rear partial section view of the first embodiment of the present invention with left leaning baseplate 100, with left side compression of upper elastomeric component 140 (not shown) and right side compression of lower elastomeric component 150 (not shown), with left leaning floating revolute kingpin 120, and hanger 160 steering to the left.

DETAILED DESCRIPTION OF THE INVENTION

Specific exemplary embodiments of the invention are illustrated in the figures and described herein. However, the invention may be embodied in many different forms and should not be construed as limited to these exemplary embodiments. Unless specifically noted, articles depicted in the drawings are not necessarily drawn to scale.

It will be understood that although the terms "first" and "second" are used herein to describe various elements, these elements should not be limited by these terms. These terms are used only to distinguish one element from another element.

The trucks described herein may be used with many different riding devices, including but not limited to scooters, skateboards, or kneeboards. All riding devices shall sometimes be collectively referred to as "skateboards" herein.

Kinematic Description of a First Embodiment of the Invention (description of space mechanism).

Figure 6:
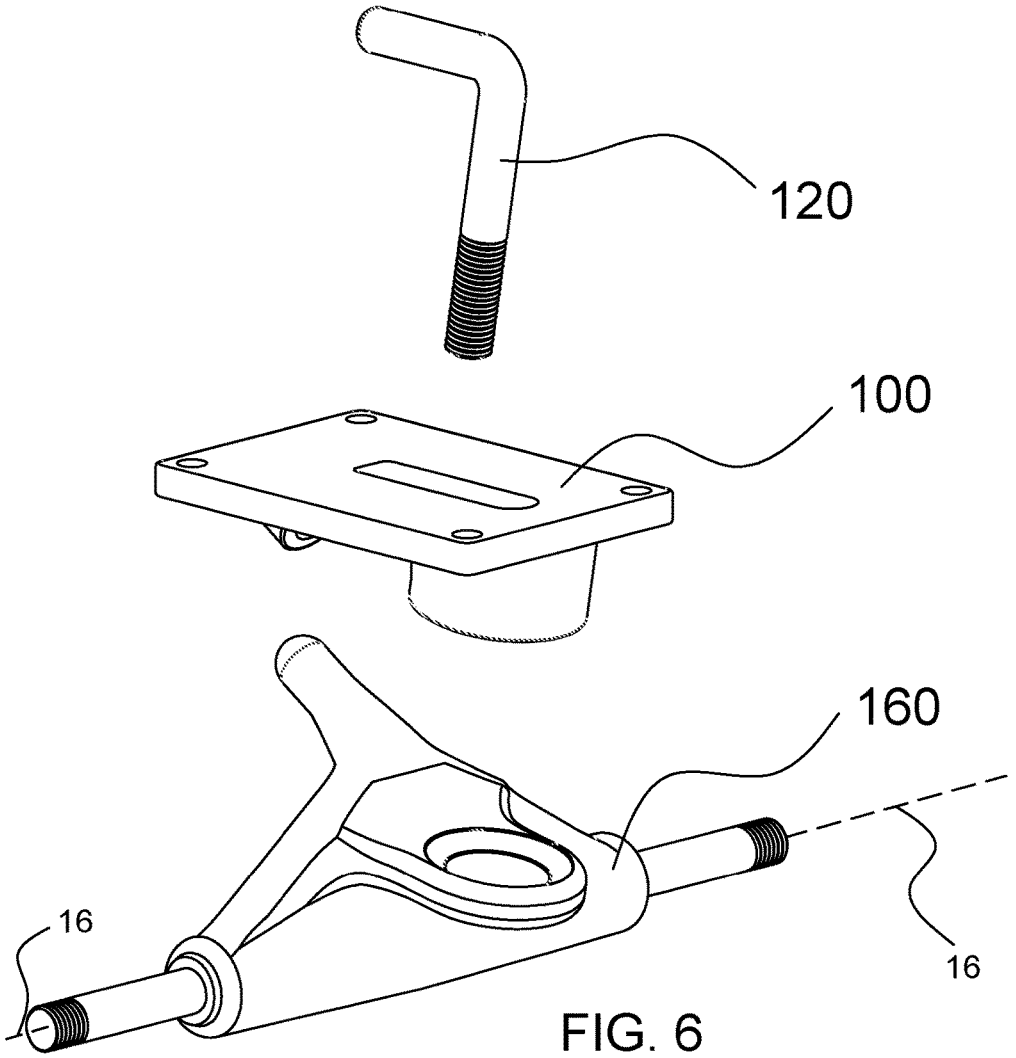
FIG. 6 shows the three rigid bodies of the first embodiment of the present invention.
Figure 7:
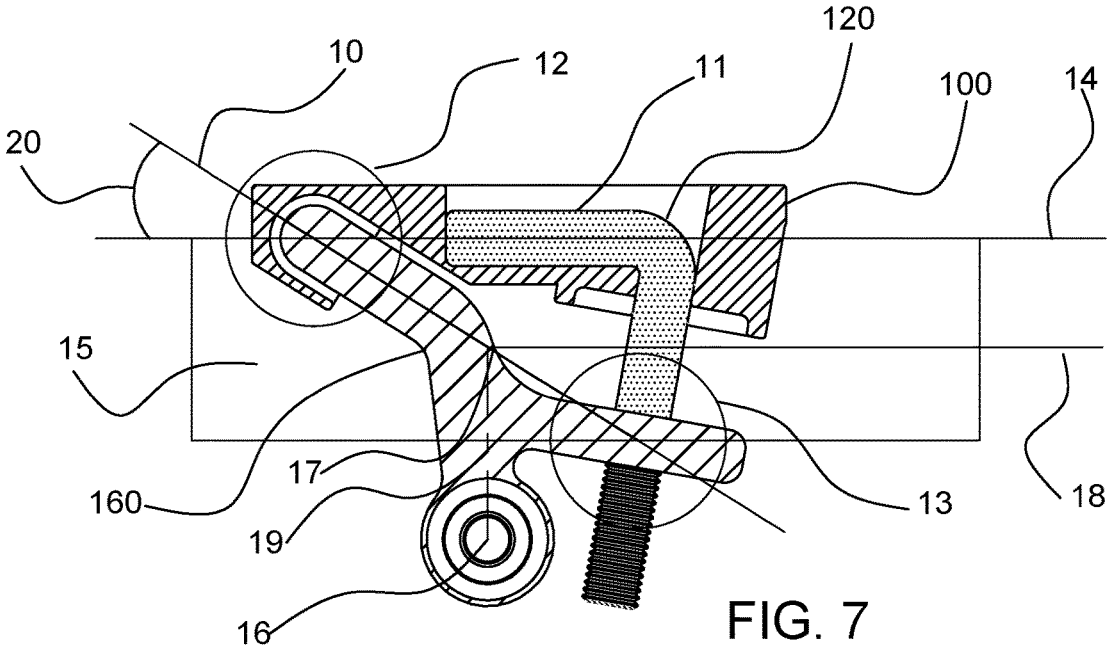
FIG. 7 shows the kinematic diagram of the first embodiment of the present invention.

FIGS. 6 and 7 show that a first embodiment of a truck of the present invention is a space mechanism with three rigid bodies and two degrees of freedom.

For the truck of the present invention, not connected with a skateboard, the three rigid bodies are comprised of the baseplate 100; the hanger 160; and the revolute floating kingpin 120.

Kinematic diagram 7 shows a first pair of rigid bodies baseplate 100 and revolute floating kingpin 120 moveably connected by revolute joint 11. A second pair of rigid bodies baseplate 100 and hanger 160 are moveably connected by spherical joint 12. A third pair of rigid bodies revolute floating kingpin 120 and hanger 160 are moveably connected by spherical joint 13.

Figure 8:
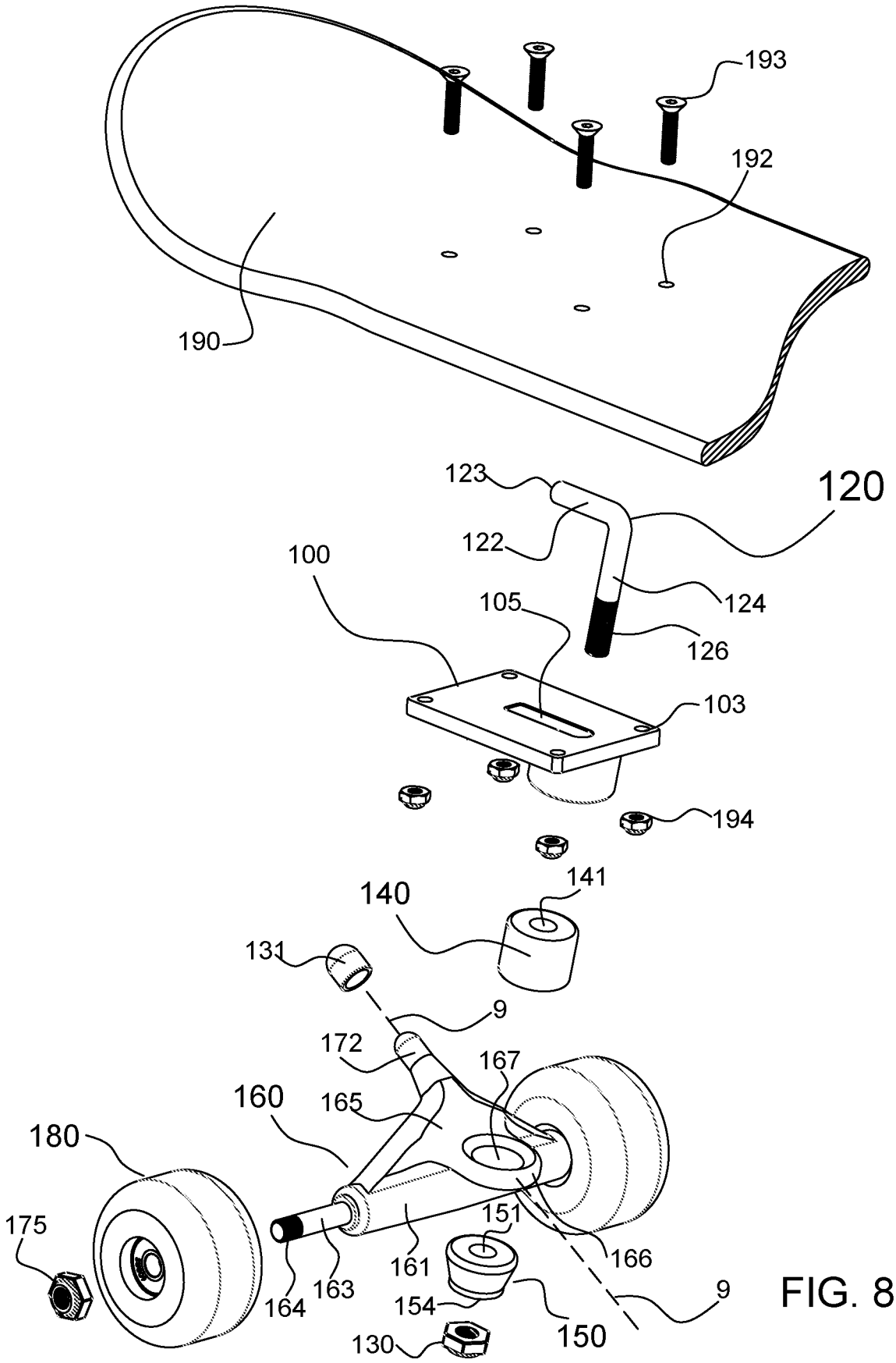
FIG. 8 shows an exploded view of the first embodiment of the present invention.

Upper spherical joint 12 and lower spherical joint 13 are elastomerically coupled and constrained by elastomeric components 140 and 150 shown in FIG. 8.

A hanger pivot axis 10 is a virtual line projected between the centroid point of upper spherical joint 12 and a centroid point of lower spherical joint 13. Rotation about hanger pivot axis 10 is the first degree of freedom.

A longitudinal roll axis 14 is concentric with the axis of rotation of revolute joint 11. Longitudinal roll axis 14 may be defined by a revolute joint, or by any other joint that allows for a similar roll axis at or near deck level. Longitudinal roll axis 14 is the second degree of freedom.

A hanger pivot axis angle 20 is defined by the angle of the hanger pivot axis 10 and the plane of the ground when the truck is in a non-leaning, i.e. central and neutral position. As a non-limiting example, FIG. 7 shows longitudinal roll axis 14 parrallel to the ground.

A virtual pivot point 17 is located at the intersection of hanger pivot axis 10 and a line 19 vertically projected from the centeral point of hanger axle axis 16.

With the assembly of a riding device, a front and a rear truck are connected with a deck or other riding device. A virtual pivot point roll axis 18 is coincident with a virtual line projected between a virtual pivot point 17 of the front truck and a virtual pivot point 17 of the rear truck.

A hanger pivot plane 15 is a virtual plane defined by the longitudinal roll axis 14 and the hanger pivot axis 10, and by the central plane of the revolute kingpin 120.

The hanger pivot plane 15 is useful for understanding the motions and degrees of freedom in the present invention and for understanding the difference between the fixed kingpins of prior art and the present invention.

Figure 1:
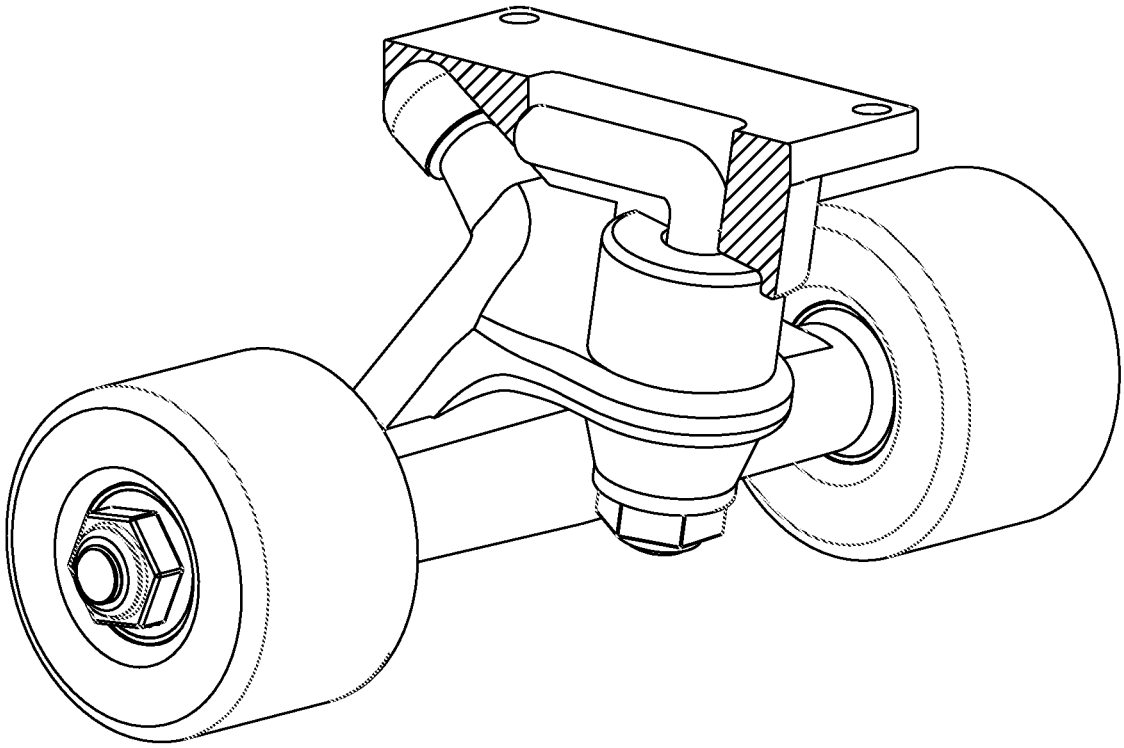
FIG. 1 shows partial cut away perspective view of the preferred embodiment of present invention.
Figure 2:
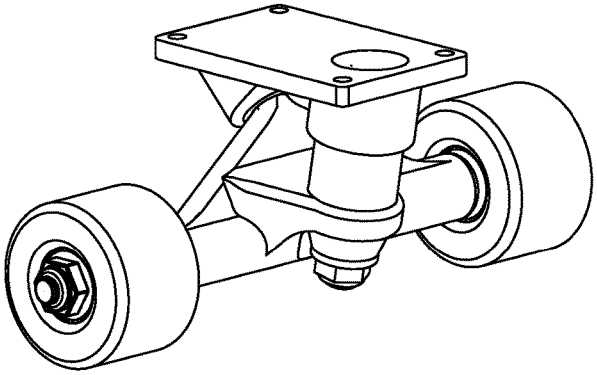
FIG. 2 Prior Art
FIG. 2 shows the fixed kingpin truck of prior art.
Figure 3:
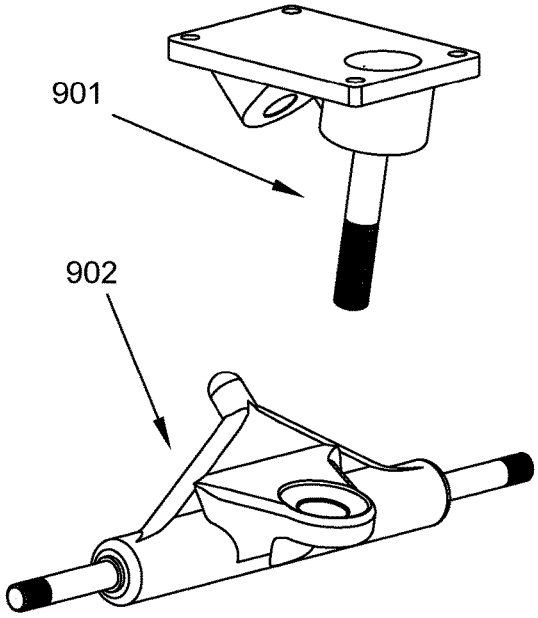
FIG. 3 Prior Art
FIG. 3 shows the two rigid bodies the fixed kingpin truck of prior art.
Figure 4:
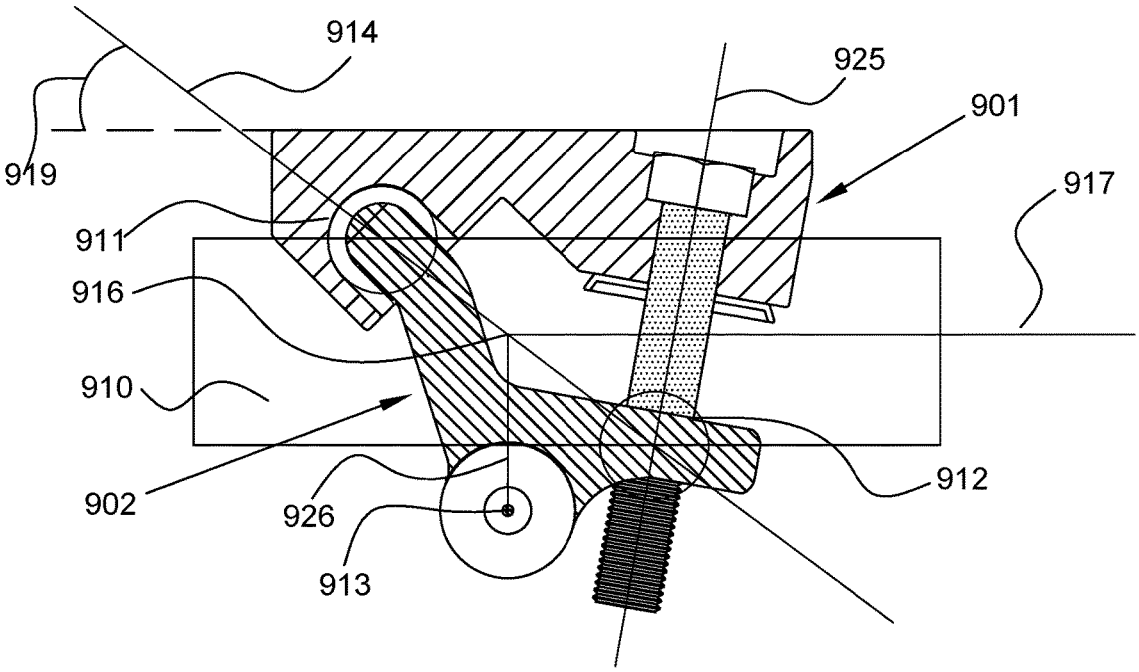
FIG. 4 Prior Art
FIG. 4 shows the kinematic diagram of the fixed kingpin truck of prior art.
Figure 5:
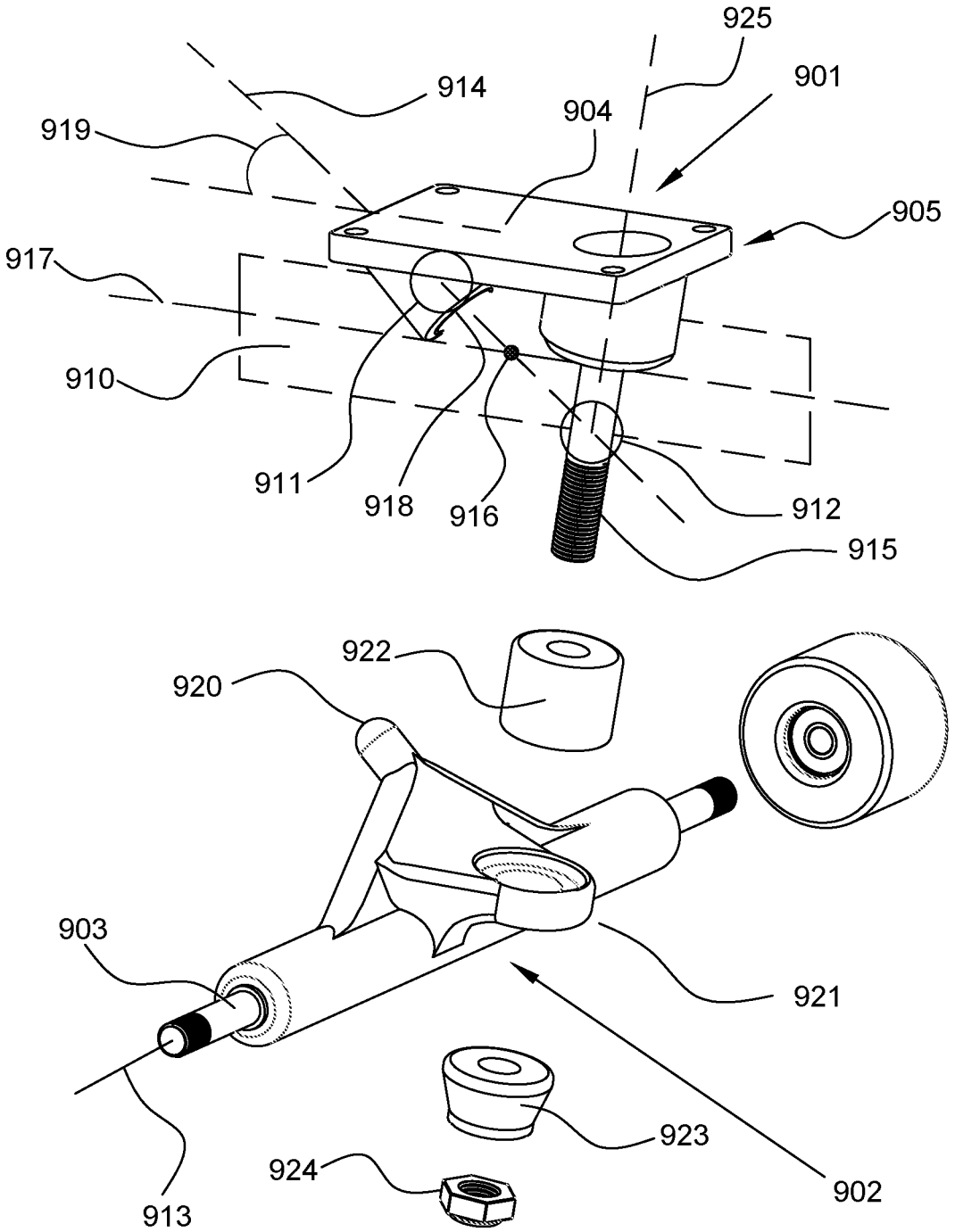
FIG. 5 Prior Art
FIG. 5 shows an exploded view of the fixed kingpin truck of prior art.

With the fixed kingpin trucks of prior art, hanger pivot plane 910, shown in FIG. 4, is the central plane and a fixed part of the geometry of a rigid body comprised of deck and mounted baseplate and fixed kingpin 901. As such, the hanger pivot plane leans with the lean of the deck, mounted baseplate, and fixed kingpin.

In contrast the hanger pivot plane 15 of the present invention is the central plane of the revolute kingpin 120. The upper spherical joint, the lower spherical joint, and the revolute joint provide specific connection and kinematic independence between between the three rigid bodies. So defined, the hanger pivot plane of the present invention floats along with the the motion of the revolute kingpin.

Figure 9:
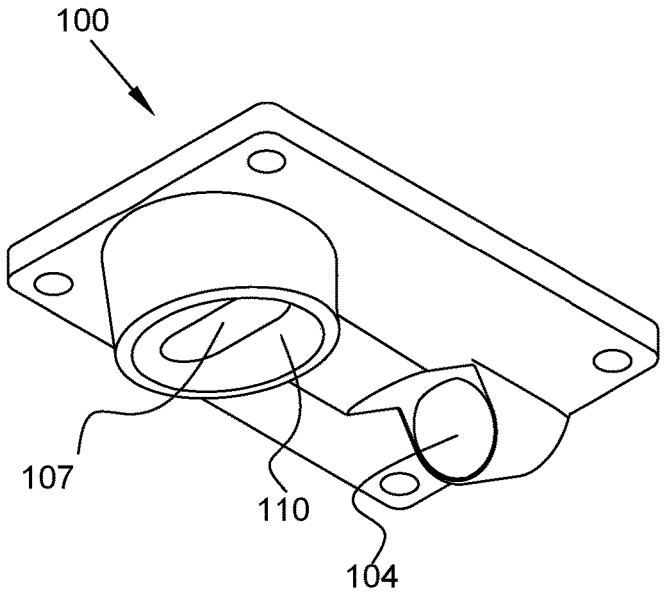
FIG. 9 shows a perspective view of the baseplate of the first embodiment of the present invention.
Figure 10:
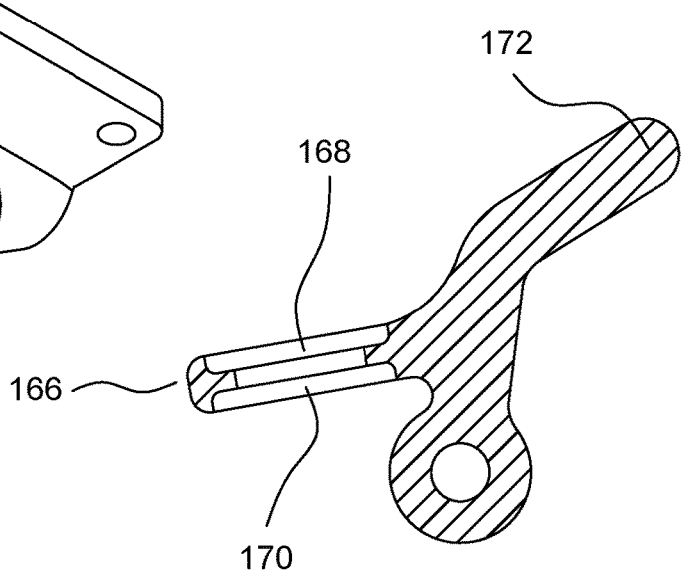
FIG. 10 shows a side section view of the hanger of the first embodiment of the present invention.
Figure 11:
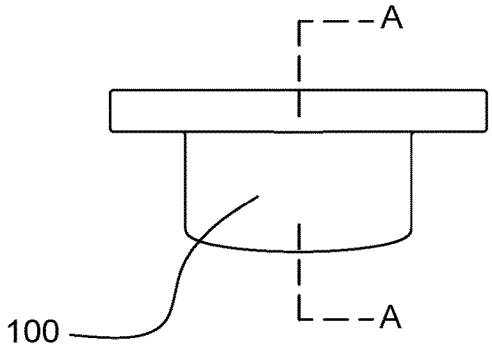
FIG. 11 shows a front view of the baseplate of the first embodiment of the present invention.
Figure 12:
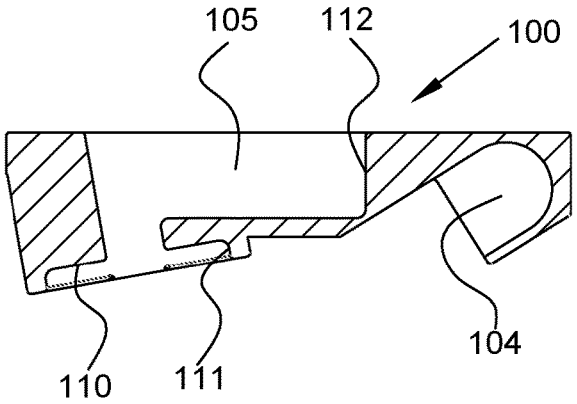
FIG. 12 shows a side section view along line 12-12 of the baseplate of the first embodiment of the present invention.
Figure 21:
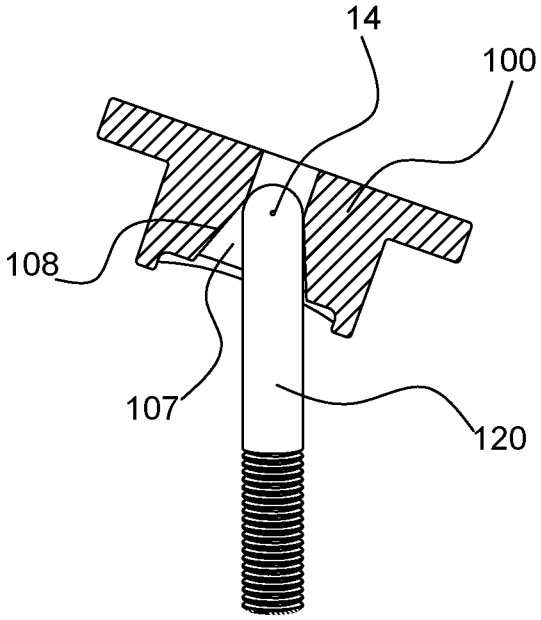
FIG. 21 shows a rear section view of right leaning baseplate 100 and floating revolute kingpin 120 of the first embodiment.

As shown in FIGS. 8-12, horizontal projecting member 122 of revolute kingpin 120 fits into pocket 105 in the top surface of baseplate 100. Horizontal member 122 of kingpin 120 is contained within the sidewalls and bottom surface of pocket 105. In some embodiments the sidewalls are parallel. In other embodiments the sidewalls may be angled. An outside bearing surface of horizontal member 122 of floating revolute kingpin 120 moveably connects and mates with the inside surface comprising the pocket sidewalls and pocket bottom surface of pocket 105 to form revolute joint 11. Revolute joint 11 is concentric with the longitudinal roll axis 14. End surface 123 of horizontal member 121 of kingpin 120 contacts with flat surface 112 of pocket 105 and so constrains the outbound axial movement of revolute kingpin 120. Slot 105 is connected with free float chamber 107 and with bushing recess 110, as shown in FIGS. 9 and 21. The oval bore in bushing recess 110 has a length and a width, and the length of the oval bore defines range of motion of the revolute floating kingpin.

Downward projecting member 124 of kingpin 120 passes through pocket 105, through free float chamber 107, through an oval bore 107 disposed within bushing recess 110 of the baseplate 100, through a central bore 141 of upper elastomeric component 140, through the 167 in yoke 166, through bore 151 in lower elastomeric component 150, and through locking nut 130, and the locking nut is tightened against a bottom surface 154 of the lower elastomeric component 150.

A top portion of upper elastomeric component 140 is contained and constrained by bushing recess 110 in baseplate 100. A bottom portion of upper elastomeric component 140 is constrained and contained by upper yoke recess 168.

Downward projecting member 124 of kingpin 120 passes through bore 167 of yoke 166. and is constrained by upper elastomeric component 140 and lower elastomeric component 150, forming lower spherical joint 13.

In a preferred embodiment, pivot cup insert 131 is contained within pivot cup recess 104 of baseplate 100. In other embodiments, pivot cup insert 131 may be integrated with baseplate 100, it is not necessary that pivot cup insert 131 be a separate structure.

Pivot arm 172 is received and constrained by pivot arm recess 104 in baseplate 100, forming upper spherical joint 12. In the preferred embodiment, pivot arm 172 of hanger 160 is received by and contained within pivot cup insert 131 inside of pivot arm recess 104, forming upper spherical joint 12.

Hanger 160 is comprised of axle member 161 which surrounds axle 163 with threaded ends 164, projecting member 165 with pivot arm 172 at the distal end, and ring-shaped yoke 166 with bore 167. Hanger axle axis 16 is coincident with the center of axle 163.

In the preferred embodiment, pivot arm 172 of hanger 160 is received by and contained within pivot cup insert 131 as downward projecting member 124 of kingpin 120 passes through bore 167 of ring-shaped yoke 166 of hanger 160 until the bottom portion of elastomeric component 140 is contained and constrained by upper recess of 168 of ring-shaped yoke 166 of hanger 160.

Downward projecting member 124 of kingpin 120 further passes through central bore 151 of lower elastomeric component 150. The top portion of lower elastomeric component 150 is contained and constrained by lower yoke recess 170 of ring-shaped yoke 166 of hanger 160. Ring-shaped yoke 166 of hanger 160 is sandwiched between elastomeric components 140 and 150.

In a preferred embodiment, the truck assembly of the present invention is completed by threading kingpin locking nut 130 onto threads 126 of downward projecting member 124 of kingpin 120. Upon tightening, locknut 130 mates with the bottom surface 154 of elastomeric component 150. A washer may be between nut 130 and the bottom face 154 of elastomeric component 150. In other embodiments, the kingpin may be connected with the bottom of elastomeric component 150 by any means known in the art.

Adjustment of kingpin locking nut 130 compresses elastomeric components 140 and 150 to control elastomeric pre-load, constrain the inboard movement of floating revolute kingpin 120, and constrain the disassembly of hanger pivot arm 122 from pivot cup 131.

One wheel 180 mount on each end of axle 163 of hanger 160, and wheels 180 are secured by nuts 175 tightening onto threads 164 of axle 163.

In some embodiments, a fully assembled truck of the present invention is mounted to the bottom of a deck 190. In a preferred embodiment, truck mounting screws 193 pass through mounting holes 192 in deck, through mounting holes 103 in baseplate 100 and are secured with nuts 194. In other embodiments, a truck assembly may be mounted to a riding deck by any means known in the art.

The front and rear trucks may be identical.

Symmetrically mounting a second truck to the opposite end of the deck completes the assembly of a skateboard with trucks of the present invention.

Kinetic Description of the Invention (discussion of motion).

With the assembly of a skateboard of the first embodiment of the present invention in use with wheels constrained by the plane of the ground the first primary motion of leaning is understood to be a blended combination of rotation of baseplate and deck assembly about the longitudinal roll axis 14 and rotation of baseplate and deck assembly and hanger pivot plane 15 about virtual pivot point roll axis 18.

With the assembly of a skateboard of the present invention in use with wheels constrained by the plane of the ground the second primary motion of steering is understood to be a blended combination of steering caused first by rotation of the hanger about the hanger pivot axis 10 and second by a range of steering independent of leaning and thus subject to other inputs like road vibration and lateral forces.

With the assembly of a skateboard of the present invention in use with wheels constrained by the plane of the ground a third primary motion of floating is understood to be a range of independence between the motions of steering and leaning.

Kinematic Description of the Second Embodiment (description of space mechanism).

Figure 13:
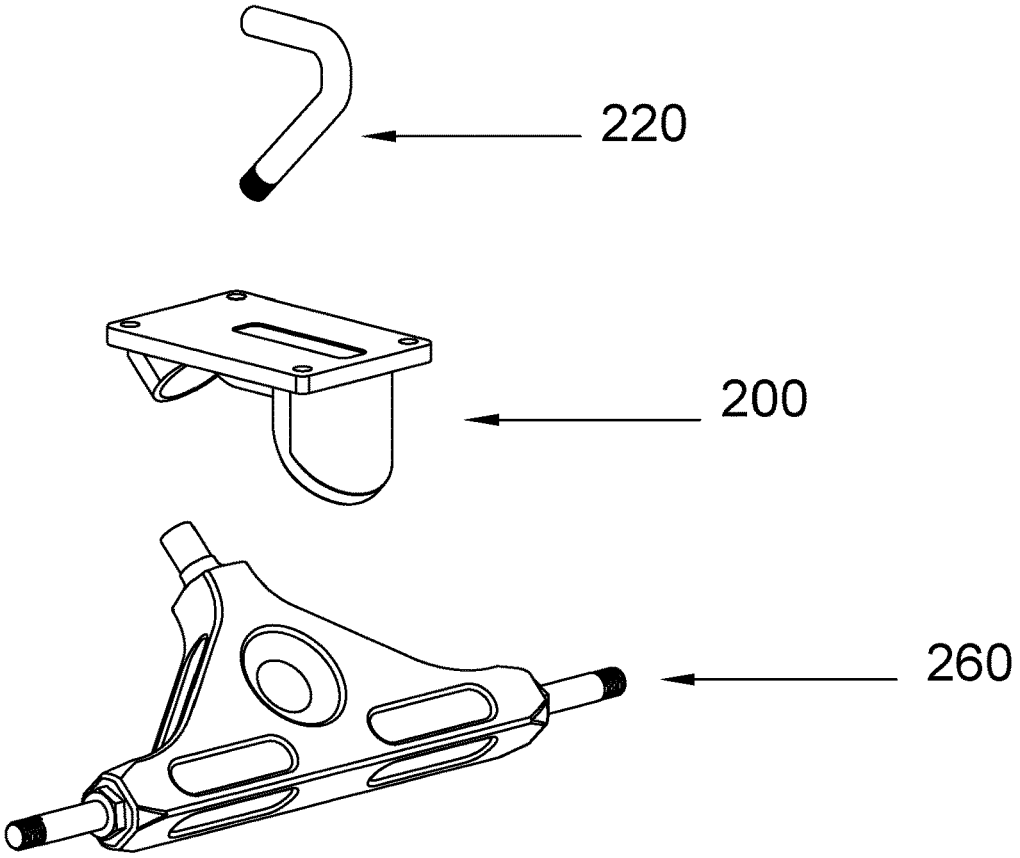
FIG. 13 shows the three rigid bodies of the second embodiment of the present invention.
Figure 14:
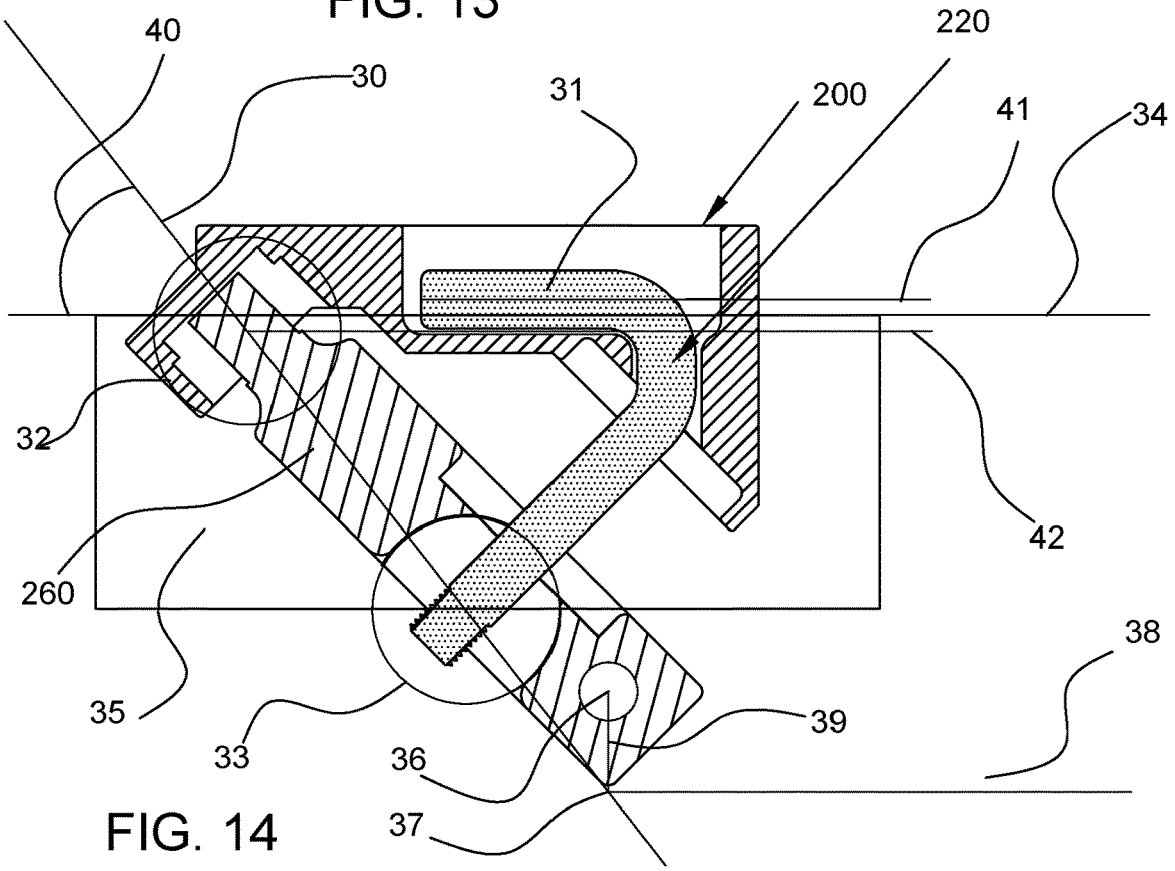
FIG. 14 shows the kinematic diagram of the second embodiment of the present invention.

FIGS. 13 and 14 show that the second embodiment of the present invention is kinematically similar to the first embodiment, with three rigid bodies and two degrees of freedom.

FIG. 13 shows three rigid bodies are comprised of baseplate 200; hanger 260;

and revolute floating kingpin 220. Kinematic diagram 14 shows a first pair of rigid bodies baseplate 200 and revolute floating kingpin 220 moveably connected by revolute joint 31. A second pair of rigid bodies baseplate 200 and hanger 260 moveably connected by spherical joint 32. A third pair of rigid bodies revolute floating kingpin 220 and hanger 260 are moveably connected by spherical joint 33.

Figure 15:
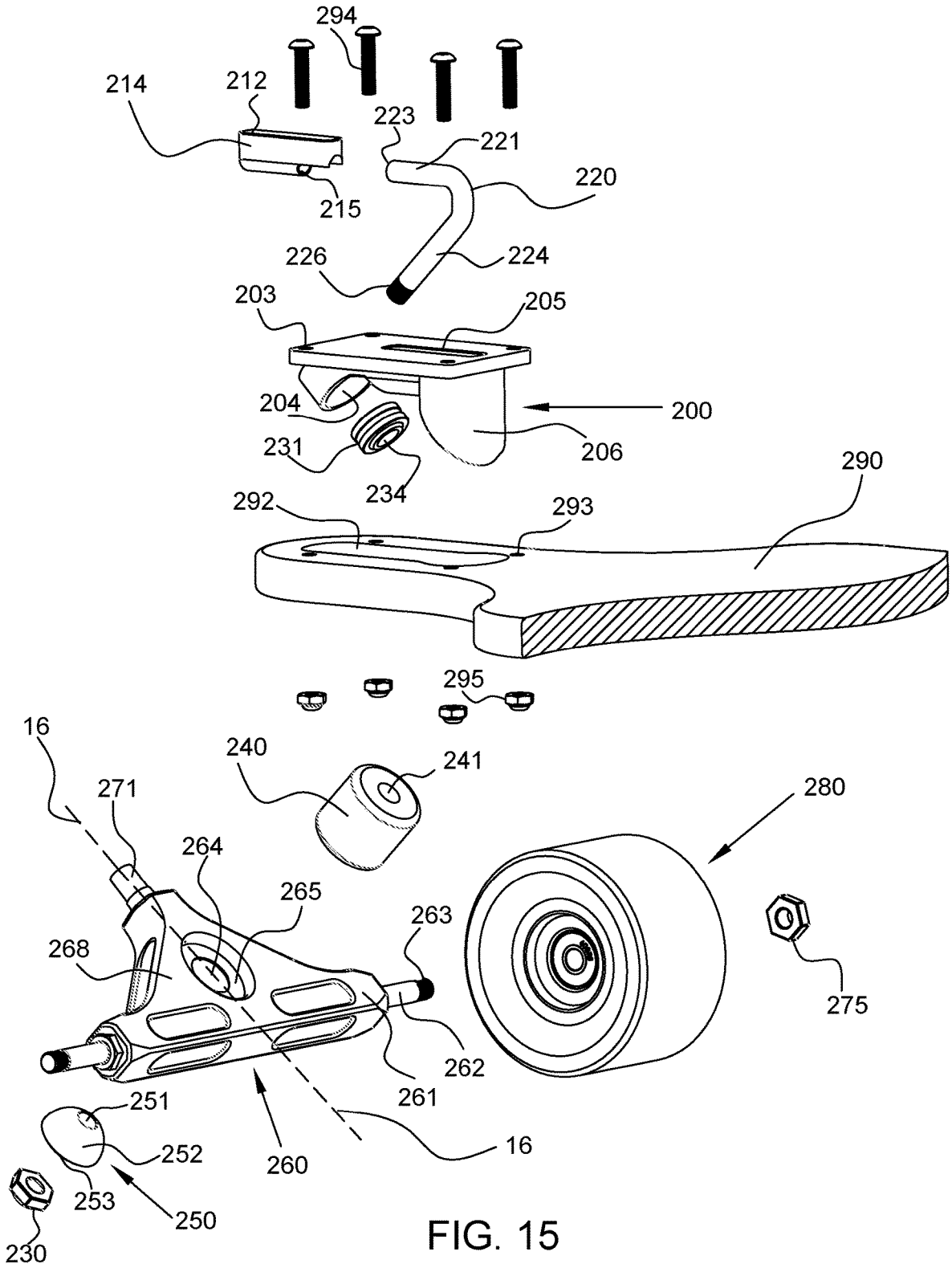
FIG. 15 shows an exploded view of the second embodiment of the present invention.
Figure 16:
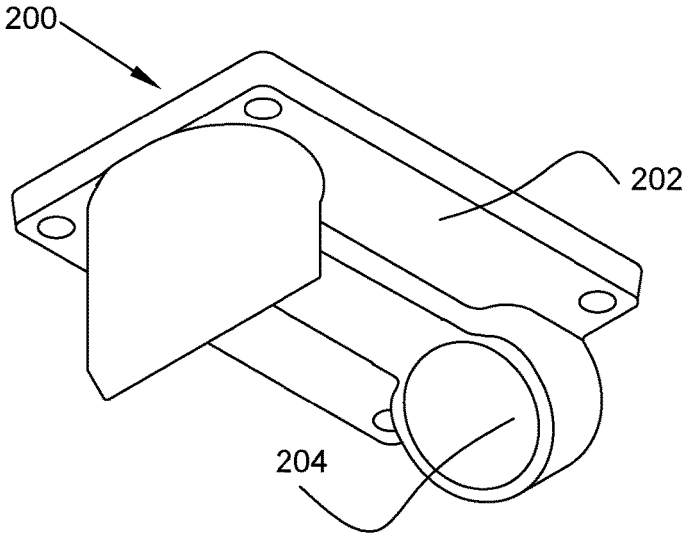
FIG. 16 shows a perspective view of the baseplate of the second embodiment of the present invention.
Figure 17:
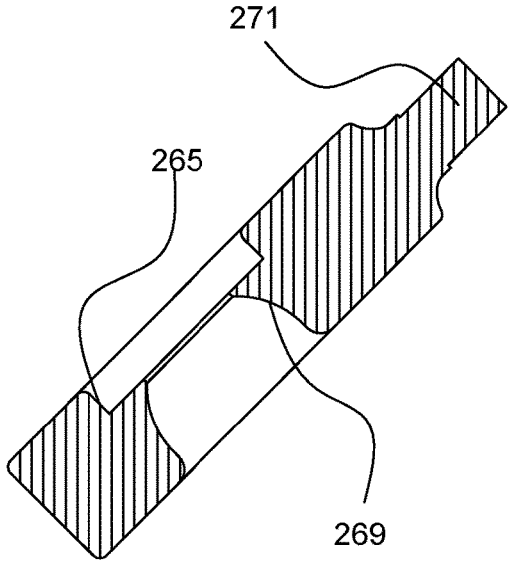
FIG. 17 shows a side section view of the hanger of the second embodiment of the present invention.
Figure 18:
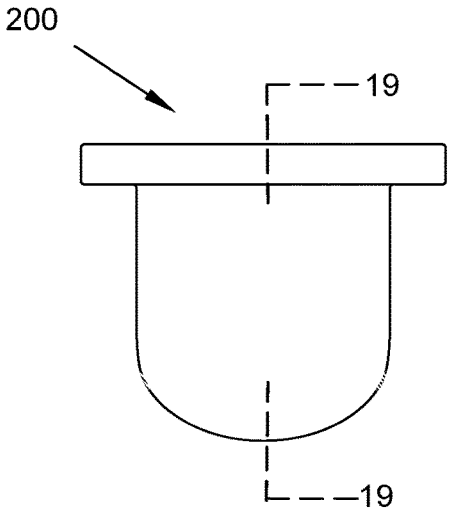
FIG. 18 shows a front view of the baseplate of the second embodiment of the present invention.
Figure 19:
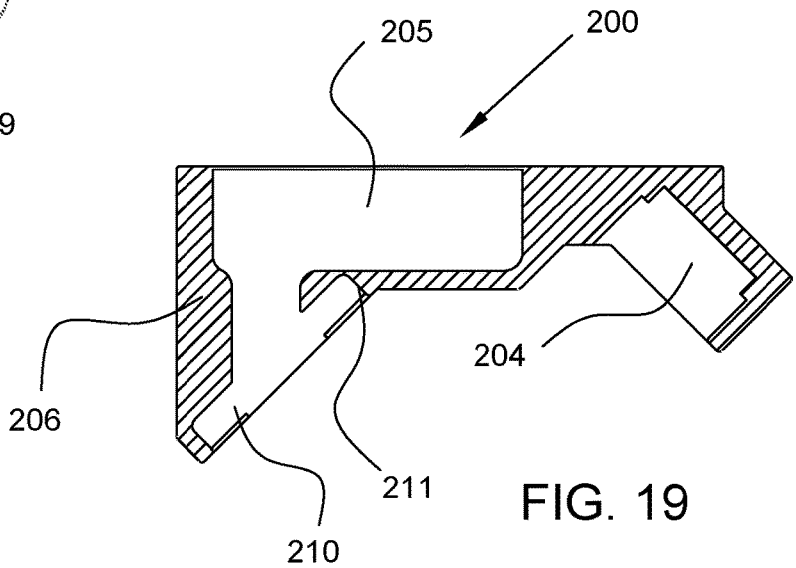
FIG. 19 shows a cross section view along line 19-19 of the baseplate of the second embodiment of the present invention.

Spherical joints 32 and 33 are elastomerically coupled and constrained by elastomeric component 240 shown in FIG. 15.

A hanger pivot axis 30 is defined by the centroid points of upper spherical joint 32 and lower spherical joint 33. Rotation about hanger pivot axis 30 is the first degree of freedom.

Unlike the first embodiment, in this second embodiment the axis of rotation of revolute joint 31 and the centroid point of spherical joint 32 are not coincident. Therefore, blended longitudinal roll axis 34 is a blended roll axis defined by the longitudinal roll axis 41 of revolute joint 31 and by an axis 42 formed by the centroid points of the upper spherical joint 32 of the front and rear trucks when assembled as a riding device with a deck. Blended longitudinal roll axis 34 is the second degree of freedom.

A hanger pivot axis angle 40 is defined by the angle of the hanger pivot axis 30 and the plane of the ground when the truck is in a non-leaning, ie central and neutral position.

A virtual pivot 37 is defined by the intersection of hanger pivot axis 30 and a line 39 vertically projected downward from the center of hanger axle axis 36. The hanger axle axis 36 is coincident with the center of axle 262.

With this second embodiment the virtual pivot point 37 is below the hanger axle axis 36 along with virtual pivot point roll axis 38. Virtual pivot point roll axis 38 is defined by the virtual pivot points 37 of the front truck and rear truck of the second embodiment mounted to a skateboard.

FIGS. 15-19 show further details of the second embodiment. In a preferred embodiment, spherical bearing 231 is a precision component with a spherical bearing surface. Spherical bearing 231 is preferably press fit into spherical bearing chamber 204 in baseplate 200. In other embodiments, spherical bearing 231 may be securely connected with spherical bearing chamber 204 by any means known in the art. Pivot arm 271 of hanger 260 moveably connects with central bore 234 of spherical bearing 231 to complete assembly of upper spherical joint 32. Central bore 234 has an inner race that rotates spherically.

Horizontal member 221 of revolute kingpin 220 inserts into bore 215 of revolute kingpin bushing insert 214 such that an outside surface of horizontal member 221 mates with an inner surface of bore 215 to form revolute joint 21. Flat end surface 223 of horizontal member 221 of kingpin 220 mates with an interior end surface of kingpin bushing insert bore 215 to constrain the outboard direction of axial movement of floating revolute kingpin 220. As used herein, outboard direction is toward the front or rear of an assembled skateboard, relative to the center.

Baseplate 200 is mounted to deck 290. Baseplate 200 may be mounted to the top surface, or to the bottom surface of the deck, or may be integrated with the deck. In a preferred embodiment, shown in FIG. 15, baseplate 200 mounted to the top of the deck. In this embodiment, baseplate 200 passes through drop through cutout 292 in deck 290 and an underside surface 202 of baseplate 200 mates with the top surface of deck 290. Screws 294 are passed through mounting holes 203 of baseplate 200 and through holes 293 in deck 290 and secured with nuts 295. In other embodiments, baseplate 200 may be mounted to deck 290 by any means known in the art.

Horizontal projecting member 221 of kingpin 220 inserts into pocket 205 in baseplate 200 until revolute kingpin bushing insert 214 is contained within the sidewalls of pocket 205 in baseplate 200. In some embodiments, these sidewalls are parallel. In other embodiments, the sidewalls may be angled. Downward projecting member 224 passes through pocket 205, through angled sidewalls 208 that comprise free float chamber 207, and through an oval bore disposed within bushing recess 210.

Downward projecting member 224 of kingpin 220 passes through central bore 241 of elastomeric component 240. The top portion of elastomeric component 240 is contained and constrained by bushing recess 210 of baseplate 200.

Hanger 260 is comprised of axle member 261 which surrounds axle 262 with threaded ends 263, projecting member 268 with pivot arm 271 at the distal end, a bushing recess 265 on the upper surface of hanger 268, hanger bore 264 disposed within bushing recess and open to hemispheric surface 269 on the lower surface of hanger 268. Hanger bore 264 creates an opening between hanger bushing recess 264 and hemispheric surface 269.

Downward projecting member 224 of kingpin 220 further passes through central bore 264 of hanger 260, and the lower portion of elastomeric component 240 is contained and constrained within recess 265 of hanger 260.

Downward projecting member 224 of kingpin 220 further passes through bore 251 of hemispheric bearing 250.

Assembly is secured by threading kingpin locking nut 230 onto threads 226 of downward projecting member 224 of kingpin 220.

Upon tightening, kingpin locking nut 230 tightens against the bottom flat surface 253 of hemispheric bearing 250. Spherical bearing surface 252 of hemispheric bearing 250 mates with hemispheric surface 269 on the lower surface of hanger 268. bottom of bore 264 of hanger 260 to form lower spherical joint 33.

Adjustment of kingpin locking nut 230 compresses elastomeric component 240 to control elastomeric pre-load, constrain the inboard movement of floating revolute kingpin 220, and constrain the disassembly of hanger pivot arm 271 from spherical bearing 231. As used herein, inboard direction is toward the center of an assembled skateboard.

One wheel 280 mount on each end of axle 262 of hanger 260 and the wheels 280 are secured by nuts 275 tightening onto threads 263 of axle 262.

Front and rear trucks may be identical. Symmetrically mounting a second truck to the opposite end of the deck completes the assembly of a skateboard with trucks of the present invention.

Kinetic Description of the Second Embodiment.

The kinetics of the second embodiment are similar to the first embodiment.

With the assembly of a skateboard of the second embodiment in use with wheels constrained by the plane of the ground the first primary motion of leaning is a blended combination of rotation of baseplate and deck assembly about the longitudinal roll axis and rotation of baseplate and deck assembly and hanger pivot plane 35 about virtual pivot point roll axis 38.

With the assembly of a skateboard of the present invention in use with wheels constrained by the plane of the ground the second primary motion of steering is a blended combination of steering caused first by rotation of the hanger about the hanger pivot axis 30 and second by a range of steering independent of leaning and thus subject to other inputs like road vibration and lateral forces.

With the assembly of a skateboard of the present invention in use with wheels constrained by the plane of the ground a third primary motion of floating is understood to be a range of independence between the motions of steering and leaning.

Figure 20:
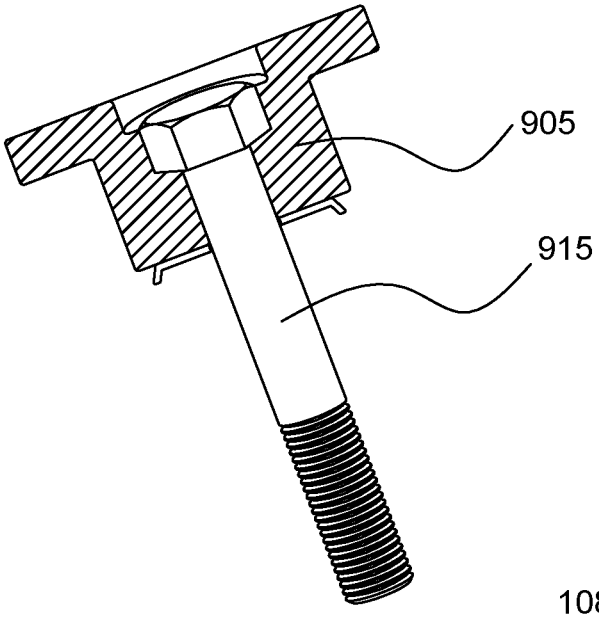
FIG. 20 Prior Art
FIG. 20 shows a rear section view of a fixed kingpin truck baseplate and kingpin of prior art, leaning.

As shown in FIG. 20 fixed kingpin trucks of prior art baseplate 905 and fixed kingpin 915 are a single rigid body and so move together.

As shown in FIGS. 21, in the first embodiment pocket 105 has sidewalls that open to angled sidewalls 108 of free float chamber 107. The base of angled sidewalls 108 opens to the oval bore in baseplate bushing recess 107, and the shape of the oval bore is contiguous with the shape of the base of angled sidewalls 108. Sidewalls and bottom surface of pocket 105 receive and constrain horizontal member 122 of revolute floating kingpin 120. The angled sidewalls 108 of the free float chamber constrain, define, and limit the range of rotation of baseplate 100 and floating revolute kingpin 120 relative to each other about axis 14 of revolute joint 11. FIG. 21 shows a rear section view of baseplate 100 leaning right relative to floating revolute kingpin 120 within free float chamber 107 about longitudinal roll axis 14.

Figure 22:
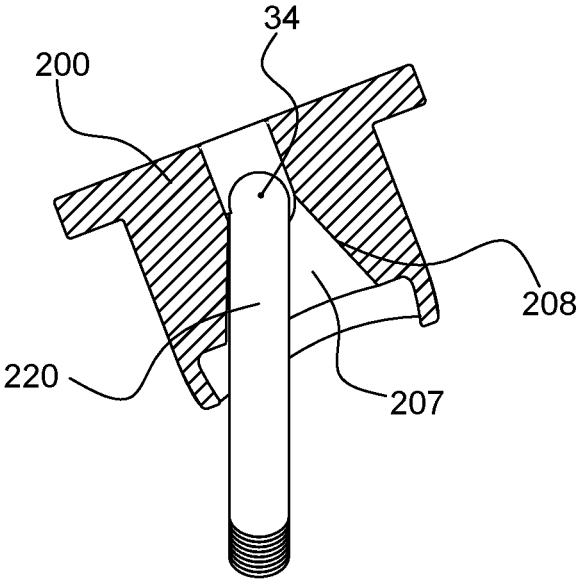
FIG. 22 shows a rear section view of left leaning baseplate 200 and floating revolute kingpin 220 of the second embodiment.

As shown in FIG. 22, in the second embodiment pocket 205 has sidewalls that open to angled sidewalls 208 of free float chamber 207. The base of angled sidewalls 208 opens to of baseplate 200 constrain the range of rotation of baseplate 200 and floating revolute kingpin 220 relative to each other about axis 34 of revolute joint 31. FIG. 22 shows a rear section view of baseplate 200 leaning left relative to floating revolute kingpin 220 within free float chamber 207 about longitudinal roll axis 34.

Figure 23:
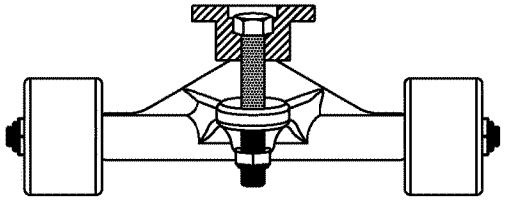
FIG. 23 Prior Art
FIG. 23 shows a rear partial section view of the fixed kingpin truck of prior art with the baseplate not leaning and the hanger not steering.
Figure 24:
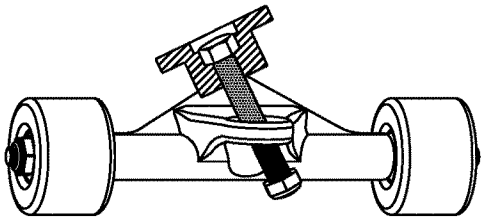
FIG. 24 Prior Art
FIG. 24 shows a rear partial section view of the fixed kingpin truck of prior art with the baseplate leaning and the hanger steering.

As shown in FIGS. 23 and 24, with existing skateboards rider input torque causes the first rigid body of deck baseplates and fixed kingpins to lean which in turn leans the hanger pivot plane and hanger pivot axis. With wheels constrained by the plane of the ground the hangers then rotate about the hanger pivot axis resulting in the traditional linked lean-steering response.

Figure 25:
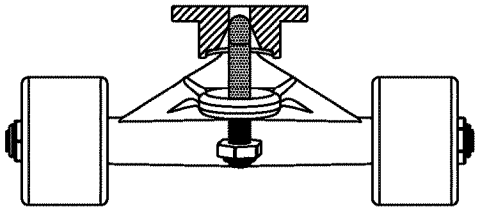
FIG. 25 shows a rear partial section view of the first embodiment of the present invention with the baseplate not leaning and the hanger not steering.
Figure 26:
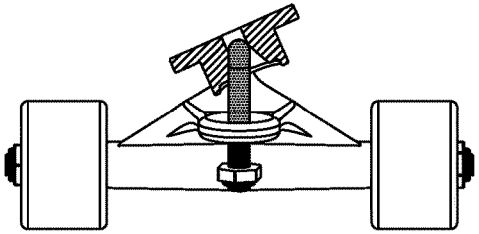
FIG. 26 shows a rear partial section view of the first embodiment of the present invention with the baseplate leaning and the hanger not steering.
Figure 27:
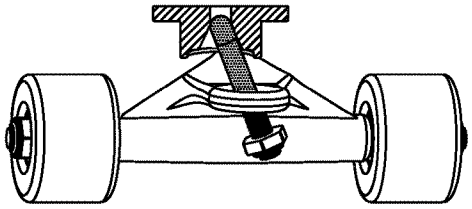
FIG. 27 shows a rear partial section view of the first embodiment of the present invention with the baseplate not leaning and the hanger steeing.

As shown in FIGS. 25-27, for the present invention, within limits defined by the range of motions of the revolute kingpin 120 or 220 within the free float chambers 107 or 207 of the baseplate, a range of leaning is possible without steering and a range of steering is possible without leaning.

FIG. 26 shows the baseplate leaning to the left, while the floating revolute kingpin is not leaning within the free float chamber, and the hanger is not steering.

FIG. 27 shows baseplate not leaning, while the floating revolute kingpin is leaning to the left within the free float chamber, and the hanger is steering to the left.

Given the kinematic independence of leaning and steering in the present invention, elastomeric bushings of the truck are necessary for the integrity of the assembly and enable several key differences and advantages over conventional fixed kingpin trucks.

Figure 28:
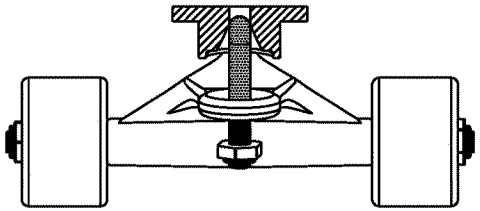
FIG. 28 shows a rear partial section view of the first embodiment of the present invention with the baseplate not leaning, the elastomeric components (not shown) in a relaxed state, and the hanger not steering.

As shown in FIGS. 28-30, elastomeric components complete the load path between the three rigid bodies of baseplate, floating revolute kingpin, and hanger. In this way the elastomeric components of the present invention function as springy couplers that connect and dampen the motions of leaning with steering.

FIG. 28 shows the truck of the present invention at rest. FIG. 29 shows the truck with an initial range of baseplate leaning where the left side of upper elastomeric component (140 or 240) is partially compressed and the transfer of torque through the elastomeric component is not sufficient to create steering of the hanger.

FIG. 30 shows full left leaning of baseplate 100, left side of upper elastomeric component (140 or 240) and right side of lower elastomeric component (150 or 250) fully compressed, thus transferring rider input torque so that revolute floating kingpin is leaned to the left with the hanger steering to the left.

Steering responsiveness and the immediacy of torque transfer between the three rigid bodies sufficient to cause steering can be controlled in several ways.

The native firmness and preload adjustment of the elastomeric components controls the steering responsiveness of the present invention such that the firmer the elastomeric bushings and the tighter the preload adjustment the more immediate the transfer of torque between the three rigid bodies and the faster the steering response.

In the first embodiment, the sidewalls of the yoke recesses 168 and 170 and baseplate recess 110 can be adjusted to provide greater or lesser degrees of constraint of the elastomeric components 140 and 150. Likewise, in the second embodiment, the sidewalls of recesses 210, 265, and 269 can be adjusted to provide greater or lesser degree of constraint of elastomeric components 240 and 250. Taller and tighter constraints result in less float and faster steering response and conversely, shorter and looser constraints result in more float and a slower steering response.

Further control of float can be achieved by adjusting the range of motion of the floating revolute kingpin within the free float chamber of the baseplates such that reduced range of motion would result in more responsive steering all else being equal.

Given equal hanger pivot axis angles, trucks of the present invention having an additional degree of freedom about the longitudinal roll axis and having the additional motion of floating require more total deck lean to achieve the same level of steering as with conventional truck designs.

Elastomeric components provide return to center force that provides initial resistance to leaning as well as progressively higher levels of resistance to leaning as the deck is leaned deeper.

Elastomeric components also provide load bearing suspension that isolates and dampens road vibration.

Ride Dynamics of a Skateboard of the Present Invention.

In some embodiments, the trucks are connected with a skateboard deck, or other similar riding devices. Skateboards operating at higher speed are subject to progressively higher levels of road vibration. In addition, the wheels on the ground will be subject to asymmetrical road impacts that cause unwanted steering. As vibration and unwanted steering transfers up from the wheels through the trucks to the rider the skateboard bounces and feels loosely connected to the ground. At the same time steering becomes hyper sensitive to rider inputs. These conditions combined with lack of rider skill can lead to a type of steering oscillation commonly called "speed wobbles" that often end with catastrophic results.

Expert skateboard riders learn to relax and absorb the unwanted vibration with their body and at the same time learn to adjust to the changing level of input sensitivity as speed increases. Riders seeking control at higher speeds tend to select trucks specifically designed for downhill speeds that have much slower steering response. Riders will set up downhill trucks with firmer elastomeric bushings and higher levels of preload adjustment. So while straight line speed is improved, maneuverability at slower speeds is greatly reduced.

As has been described in sections above, the skateboard assembly with trucks of the present invention has three primary motions of leaning, steering, and floating.

Floating and the load bearing suspension qualities of the elastomeric components allow the trucks of the present invention to isolate and dampen much more unwanted road vibration and road-caused steering impulses than conventional trucks and so provide a smoother ride with improved traction, better control and much more closely mimic the standing on liquid feel of surfing and other board sports.

Floating also means that assembled skateboards of the present invention are less sensitive to rider input for the first few degrees of deck lean which isolates steering from unintentional rider input which in turn results in more consistent primary lean-steering response throughout the speed range.

With conventional fixed kingpin trucks lateral forces in turns have little effect on steering.

In contrast, the floating kingpin truck of the present invention has a load path through the truck that results in a secondary lateral steering response such that, depending on truck geometry, rider leg extension during a turn can result in a subtle steering response of increasing the radius of the turn and a reduction of leg pressure slightly decreases the turn radius. Having this additional means of steering control results in ride dynamics that increase rider precision over when and how long the wheels slide when carving turns near the limit of traction and at the same time dramatically improves the timing and rhythm of linked turns and amplifies the floating sensation between linked turns.

Skateboards with floating kingpin trucks of the present invention have the riding surface of deck 100 very close to longitudinal roll axis 14. This proximity combined with the blended leaning motion of the deck about longitudinal roll axis (14 or 41) and the virtual pivot point roll axis (18 or 38) results in a foot-to-deck interface and deck motion that more closely mirrors the natural standing-on-water sensation surfing and other board sports.

In combination the above ride dynamics of the present invention represent a new class of lean-steering mechanisms that provides a fluid, surfing like ride feel and control.

The above description presents the best mode contemplated in carrying out the invention(s) described herein. However, it is susceptible to modifications and alternate constructions from the embodiments shown in the figures and accompanying description. Consequently, it is not intended that the invention be limited to the particular embodiments disclosed. On the contrary, the invention is intended to cover all modifications, sizes and alternate constructions falling within the spirit and scope of embodiments of the invention.

What is claimed is:

1. A truck for a riding device comprising, three rigid bodies comprising, a baseplate comprising a pivot arm recess in a bottom surface of the baseplate, a baseplate bushing recess in the bottom surface of the baseplate, an oval bore disposed within the bushing recess that opens to a free float chamber with angled side walls, wherein the angled sidewalls open to sidewalls of a pocket in a top surface of the baseplate, a revolute floating kingpin comprising a horizontal member and a downward projecting member, and a hanger comprising a yoke, a pivot arm, and axle member surrounding an axle with an axle axis;

an upper spherical joint moveably connecting the pivot arm of the hanger with the pivot arm recess in the baseplate;

a lower spherical joint moveably connecting the yoke of the hanger and the downward projecting member of the revolute floating kingpin;

a revolute joint moveably connecting the horizontal member of the revolute floating kingpin with the sidewalls of the pocket of the baseplate, wherein the free float chamber and oval bore define the range of rotation of the revolute floating kingpin relative to the baseplate;

an upper elastomeric component constrained between the bushing recess in the baseplate and an upper recess in the yoke;

a lower elastomeric component constrained between a lower recess in the yoke and a locking nut;

a hanger pivot axis between a centroid point of the upper spherical joint and a centroid point of the lower spherical joint;

a virtual pivot point at an intersection of the hanger pivot axis and a line vertically projected from a central point of the axle axis;

a longitudinal roll axis coincident with the axis of rotation of the revolute joint.

2. The truck of claim 1 wherein, the horizontal member of the revolute floating kingpin is received by the sidewalls of the pocket in the baseplate, wherein an outside bearing surface of the floating revolute kingpin moveably connects with an inside surface of the pocket forming the revolute joint;

the downward projecting member of the floating king pin passes through the pocket, the free float chamber, the oval bore, the bushing recess, a bore in the upper elastomeric component, a bore in the yoke, a bore in the lower elastomeric component, and a locking nut, wherein the locking nut tightens against a bottom surface of the lower elastomeric component;

a top portion of the upper elastomeric component is constrained by the bushing recess in the baseplate, and a bottom portion of the upper elastomeric component is constrained by an upper yoke recess;

a top portion of the lower elastomeric component is constrained by a lower yoke recess;

the lower spherical joint comprises the downward projecting member passing through yoke bore, moveably constrained by the upper elastomeric component and the lower elastomeric component; and the upper spherical joint comprises the pivot arm moveably constrained by the pivot cup recess in the baseplate.

3. The truck of claim 2 wherein a pivot cup insert is connected with the pivot cup recess of the baseplate, forming the upper spherical joint.

4. The truck of claim 1 wherein a riding device comprises a front truck and a rear truck connected with a deck, and further comprising a virtual pivot point roll axis coincident with a virtual line projected between a virtual pivot point of the front truck and a virtual pivot point of the rear truck.

5. The riding device of claim 4 wherein the elastomeric components transfer input torque from the deck to the revolute floating kingpin and hanger to steer the riding device.

6. A truck for a riding device comprising, three rigid bodies, a baseplate comprising a spherical bearing chamber in a bottom surface of the baseplate, a spherical bearing securely connected with the spherical bearing chamber, a baseplate bushing recess in the bottom surface of the baseplate, an oval bore disposed within the bushing recess that opens to a free float chamber with angled sidewalls, wherein the angles sidewalls open to sidewalls of a pocket in a top surface of the baseplate, a revolute floating kingpin comprising a horizontal member and a downward projecting member, and a hanger comprising a pivot arm, a hanger bushing recess on an upper surface of the hanger, a hanger bore disposed within the hanger bushing recess and within a hemispheric surface on a lower surface of the hanger, and axle member surrounding an axle with an axle axis;

an upper spherical joint moveably connecting the hanger pivot arm with the spherical bearing;

a lower spherical joint moveably connecting the hanger and the downward projecting member of the revolute floating kingpin, a revolute joint moveably connecting the horizontal member of the revolute floating kingpin and the sidewalls of the pocket, wherein the free float chamber and oval bore define the range of rotation of the revolute floating kingpin relative to the baseplate;

the elastomeric component constrained between the bushing recess in the baseplate and the bushing recess in the hanger;

a hanger pivot axis between a centroid point of the upper spherical joint and a centroid point of the lower spherical joint;

a virtual pivot point at an intersection of the hanger pivot axis and a line vertically projected downward from a central point of the axle axis;

a longitudinal roll axis coincident with the axis of rotation of the revolute joint.

7. The truck of claim 6 wherein the horizontal member of the revolute floating kingpin is received by the pocket in the baseplate, wherein an outside bearing surface of the floating revolute kingpin moveably connects with an inside surface of the pocket forming the revolute joint;

the downward projecting member of the floating king pin passes through the pocket, the free float chamber, the oval bore, the bushing recess, a bore in the elastomeric component, the hanger bore, a hemispheric bearing, and a locking nut, wherein the locking nut tightens against a bottom surface of the hemispheric bearing;

a top portion of the elastomeric component is constrained by the bushing recess in the baseplate, and a bottom portion of the elastomeric component is constrained by a hanger bore recess;

the lower spherical joint comprises the hemispheric bearing, the hemispheric surface of the hanger, the hanger bore, the elastomeric component, and the downward projecting member of the revolute floating kingpin; and the upper spherical joint comprises the pivot arm moveably constrained by the spherical bearing in the baseplate.

8. The truck of claim 6 wherein a riding device comprises a front truck and a rear truck connected with a deck, and further comprising a virtual pivot point roll axis coincident with a virtual line projected between a virtual pivot point of the front truck and a virtual pivot point of the rear truck.

9. The riding device of claim 8 wherein the baseplate is mounted to a top surface of the deck.

10. The riding device of claim 8 wherein the baseplate is mounted to a bottom surface of the deck.

11. The riding device of claim 8 wherein the baseplate is integrated with the deck.

12. The riding device of claim 8 wherein the elastomeric component transfers input torque from the deck to the revolute floating kingpin and hanger to steer the device.

* * * * *